US007927108B2

(12) United States Patent
Gong et al.

(10) Patent No.: US 7,927,108 B2
(45) Date of Patent: Apr. 19, 2011

(54) POWER SOCKET WITH ANTI-MISMATING MEANS

(75) Inventors: Hong-Bin Gong, Kunshan (CN); Zhong-Hua Yao, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/606,205

(22) Filed: Oct. 27, 2009

(65) Prior Publication Data

US 2010/0105226 A1 Apr. 29, 2010

(51) Int. Cl.
*H01R 12/20* (2006.01)

(52) U.S. Cl. ..... 439/63; 439/668; 439/680; 439/939

(58) Field of Classification Search ..... 439/63, 439/668, 680, 939
See application file for complete search history.

(56) References Cited

U.S. PATENT DOCUMENTS 4,605,269 A * 8/1986 Cohen et al. ..... 439/63
4,759,730 A * 7/1988 Sappington et al. ..... 439/620.3
6,168,448 B1 * 1/2001 Chang ..... 439/188
6,623,277 B1 * 9/2003 Zhu et al. ..... 439/63
6,932,614 B1 8/2005 Kan
7,029,286 B2 * 4/2006 Hall et al. ..... 439/63
7,029,331 B1 * 4/2006 Lai ..... 439/607.35
7,097,507 B1 * 8/2006 Zhang et al. ..... 439/607.35
7,666,028 B2 * 2/2010 Meleck ..... 439/502
2002/0072275 A1 * 6/2002 Arai ..... 439/680
2003/0203658 A1 * 10/2003 Zhao et al. ..... 439/63
2004/0248475 A1 * 12/2004 Seminara et al. ..... 439/680

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A power socket (100) includes an insulative housing (1), a first contact (21) and a plurality of second contacts (22) attached to the insulative housing (1) and means (185); the insulative housing (1) defines an annular first groove (16) and a first cylinder (18) disposed within the first groove (16); the first groove (16) defines a first inner surface (161) and a first outer surface (162); the first cylinder (18) defines a first passageway (181) extending through a center portion thereof along the front to back direction; the first contact (21) has a first contact portion (211) extending into the first passageway (181); each second contact (22) has a second contact portion (221) extending into the first groove (16); the means (185) extending into the first groove (16) for preventing a familiar round power plug from being inserted into the first groove (16).

20 Claims, 7 Drawing Sheets

POWER SOCKET WITH ANTI-MISMATING MEANS

BACKGROUND OF THE INVENTION

1. Field of the Invention

The present invention relates to an power socket, more particularly to an power socket with anti-mismating means.

2. Description of Related Art

Computers, audio equipment, video equipment and other electrical components include at least a signal connector for connecting with a signal cable to transfer signals. Further, in order to obtain the power, a power supply socket is also necessary for connecting with a power plug. It can be found that a familiar power supply socket includes an insulative housing with a plurality of contacts retained therein and a metal shell covering the insulative housing. The insulative housing defines an annular groove and a cylinder adjacent to the annular groove. The cylinder defines a hole extending through the centre thereof along a front to back direction. The contacts have a forked contact portion received in the hole and a plurality of resisting portions received in the annular groove. A power plug connecting with the power supply socket includes an annular insertion portion for inserting into the annular groove, and a pin formed in the annular insertion portion. The pin extends into the hole to electrically connect with the contact portion for transmitting power.

However, with a development of electrical industry, a plurality of special power supply sockets are needed for transmitting power in various electrical components. The familiar power supply sockets are used for reference in design of the special power supply socket for decreasing the mold exploitation cost, but the familiar power plugs are easily inserted into the special power supply sockets which can be destroyed the special power supply sockets.

Hence, an improved power socket is desired to overcome the above problems.

BRIEF SUMMARY OF THE INVENTION

According to one aspect of the present invention, a power socket comprises an insulative housing defining an annular first groove and a first cylinder disposed within the first groove, the first groove defining a first inner surface and a first outer surface, the first cylinder defining a first passageway extending through a centre portion thereof along the front to back direction; a first contact having a first contact portion extending into the first passageway; a plurality of second contacts, each second contact having a second contact portion extending into the first groove; and means extending into the first groove for preventing a familiar round power plug from being inserted into the first groove.

According to another aspect of the present invention, a power socket comprises an insulative housing defining a mating wall, an annular first groove recessed from the mating wall and a first cylinder disposed in the first groove; a plurality of contacts retained in the insulative housing; a pair of grounding tabs attached to two sides of the insulative housing and extending beyond the mating wall; and at least a projection extending into the first groove for preventing a familiar round power plug inserted into the first groove.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
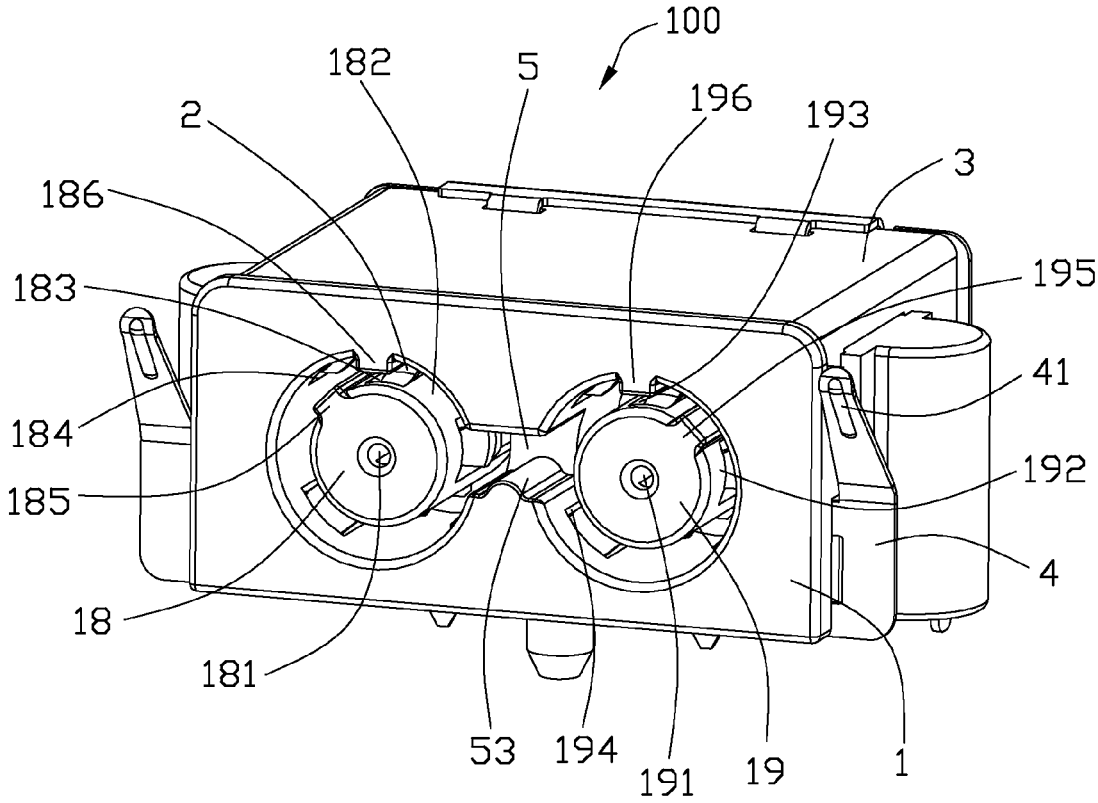
FIG. 1 is a perspective view of a power socket according to the present invention.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-7, a power socket 100 for connecting with a corresponding special power plug (not shown) according to the present invention is disclosed. The power socket 100 comprises an insulative housing 1, a plurality of contacts 2 retained in the insulative housing 1, a metal shell 3 covering the insulative housing 1 and a pair of grounding tab 4 attached to the insulative housing 1. The special power plug defines a cutout for mating with the power connector 100.

Referring to FIGS. 1-6, the insulative housing 1 has a top wall 11, a bottom wall 12, a pair of side wall 13 between the top wall 11 and the bottom wall 12, a mating wall 14 and a rear wall 15. The insulative housing 1 defines an annular first groove 16, an annular second groove 17 and a transverse throughhole or passage 5 communicating with the first and second grooves 16, 17 along a width direction of the insulative housing 1. The first and second grooves 16, 17 are recessed from the mating wall 14 and being set side by side along the width direction. The insulative housing 1 has a first cylinder 18 disposed within the first groove 16 and a second cylinder 19 disposed within the second groove 17. The first cylinder 18 is parallel to the second cylinder 19 and offset to the second cylinder 19 along the width direction. The first groove 16 has a first inner surface 161 and a first outer surface 162 which have a same centre heart 160. The first inner surface 161 and the first outer surface 162 are opposed to each other. The centre heart 160 is located at a centre portion of the first cylinder 18 in the present invention. The first inner surface 161 is an outer surface 182 of the first cylinder 18, because the first cylinder 18 is disposed within the first groove 16 in the present invention.

The first cylinder 18 defines a cylindrical first passageway 181 extending therethrough along a front to back direction of the insulative housing 1. The insulative housing 1 defines a plurality of second passageways 183 recessed from the outer surface 182 of the first cylinder 18, and a plurality of third passageways 184 recessed from the first outer surface 162. The second passageways 183 are offset from the third passageways 184 along both a circumferential direction and a radial direction of the first cylinder 18, and communicate with the first groove 16. The first cylinder 18 has a first projection 185 extending into the first groove 16 from the first inner surface 161 for preventing a familiar round power plug (not shown) from being inserted into the first groove 16. The first projection 185 extends obliquely and upwardly for mating with cutout of the corresponding power plug. In addition, the insulative housing 1 has a second projection 186 extending vertically downwardly into the first groove 16 from the peak of the first outer surface 162. The second projection 186 can prevent the familiar round power plug from being inserted into the first groove 16 too. The first projection 185 is located at a left side of the second projection 186.

The second groove 17 is similar to the first groove 16. The second groove 17 comprises a second inner surface 171 and a second outer surface 172 which have a same centre heart 170. The second inner surface 171 and the second outer surface 172 are opposed to each other. The centre heart 170 is located at a centre portion of the second cylinder 19. The second inner surface 171 is an outer surface 192 of the second cylinder 19 in the present invention. The second cylinder 19 defines a cylindrical fourth passageway 191 extending therethrough along the front to back direction. The insulative housing 1 defines a plurality of fifth passageways 193 recessed from the outer surface 192 of the second cylinder 19, and a plurality of sixth passageways 194 recessed from the second outer surface 172. The fifth passageways 193 are offset from the sixth passageways 194 along both a circumferential direction and a radial direction of the second cylinder 19. The second cylinder 19 has a third projection 195 extending into the second groove 17 from the second inner surface 171 for preventing the familiar round power plug (not shown) from being inserted into the second groove 17. The third projection 195 extends obliquely and upwardly for mating with cutout of the corresponding plug. In addition, the insulative housing 1 has a fourth projection 196 extending vertically downwardly into the second groove 17 from the peak of the second outer surface 172. The fourth projection 196 can prevent the familiar round power plug from being inserted into the second groove 17 too. The third projection 195 is located at a right side of the fourth projection 196 and symmetrical to the first projection 185.

Figure 3:
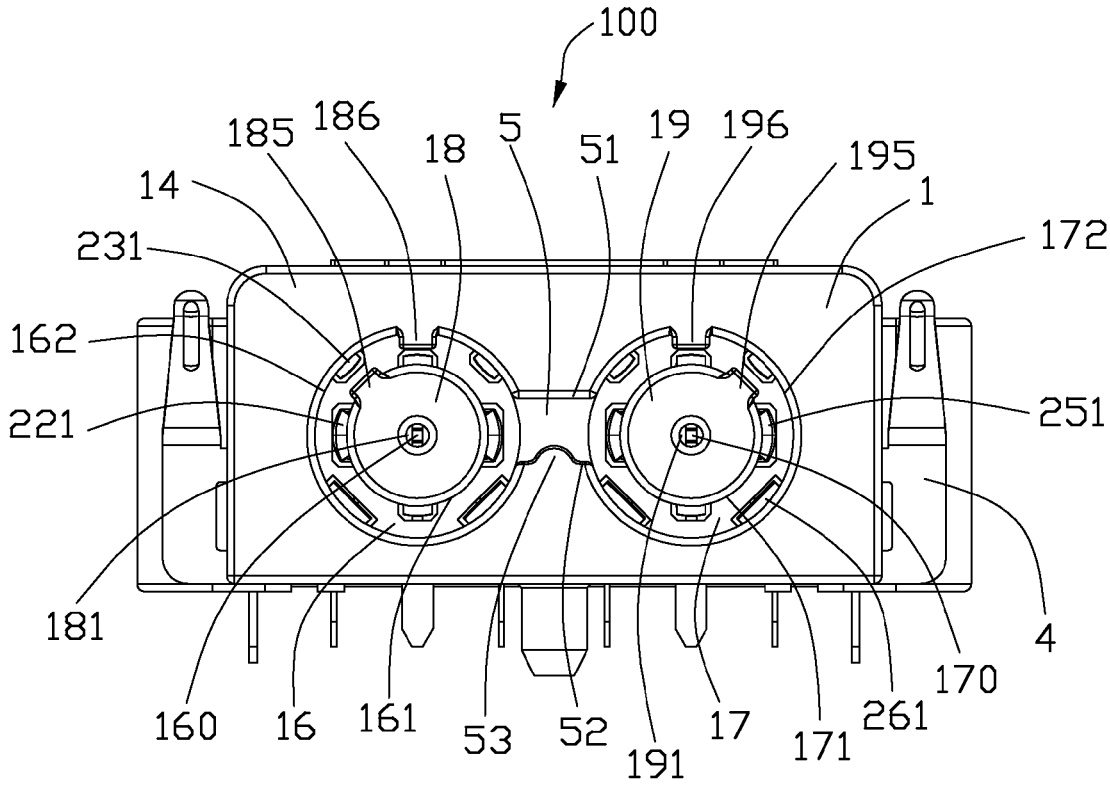
FIG. 3 is a front elevational view of the power socket shown in FIG. 1.

Referring to FIGS. 1 and 3, the insulative housing 1 has an arc protrusion 53 extending into the throughhole 5 along a top to down direction, thereby the throughhole 5 is formed with a flat upper surface 51 and an arc lower surface 52 for preventing the power plug from being inserted into the power socket 100 reversely. Of course, the throughhole 5 can be designed to have an arc upper surface 51 and flat lower surface 52 which can also prevent the power plug from being inserted into the power socket 100 reversely (referring to FIG. 7).

Figure 2:
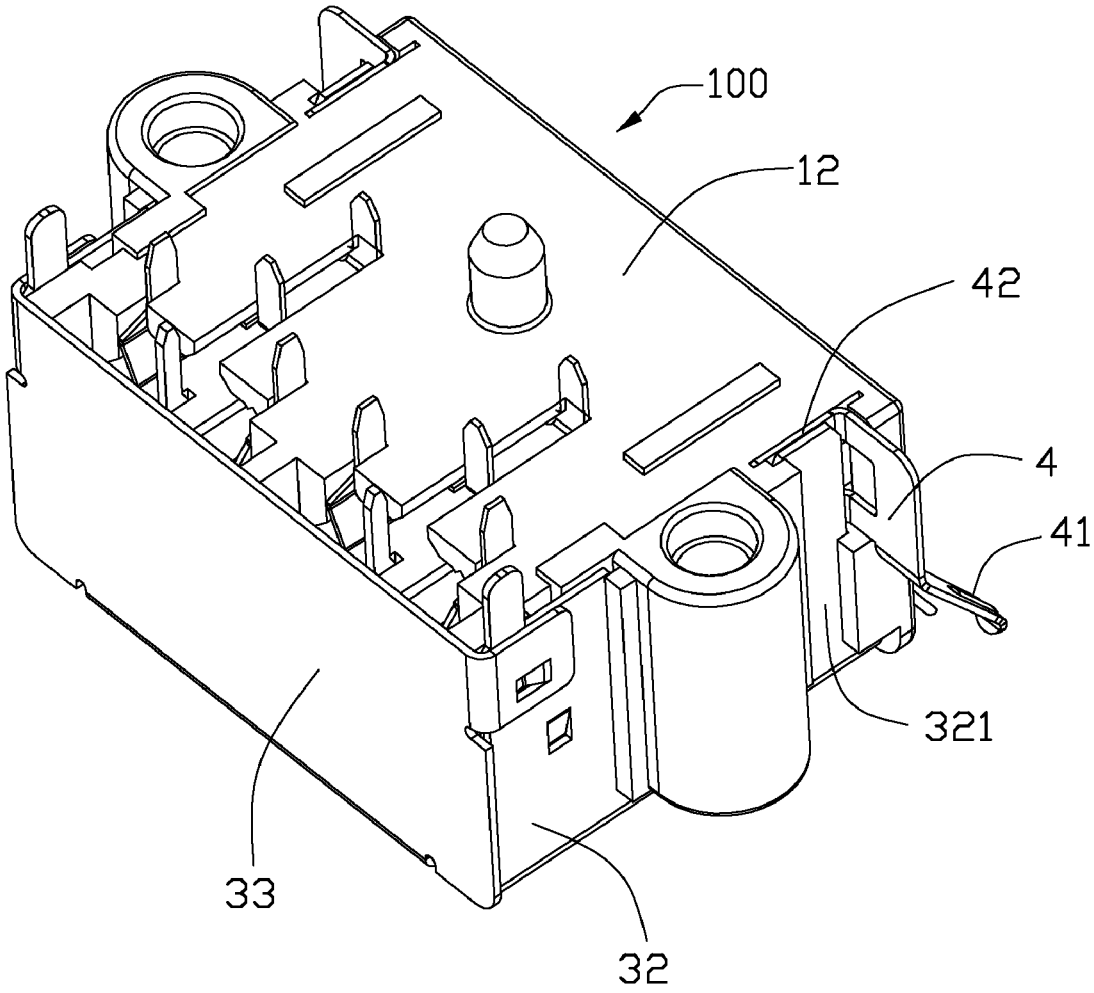
FIG. 2 is a view similar to FIG. 1, while taken from another aspect.
Figure 4:
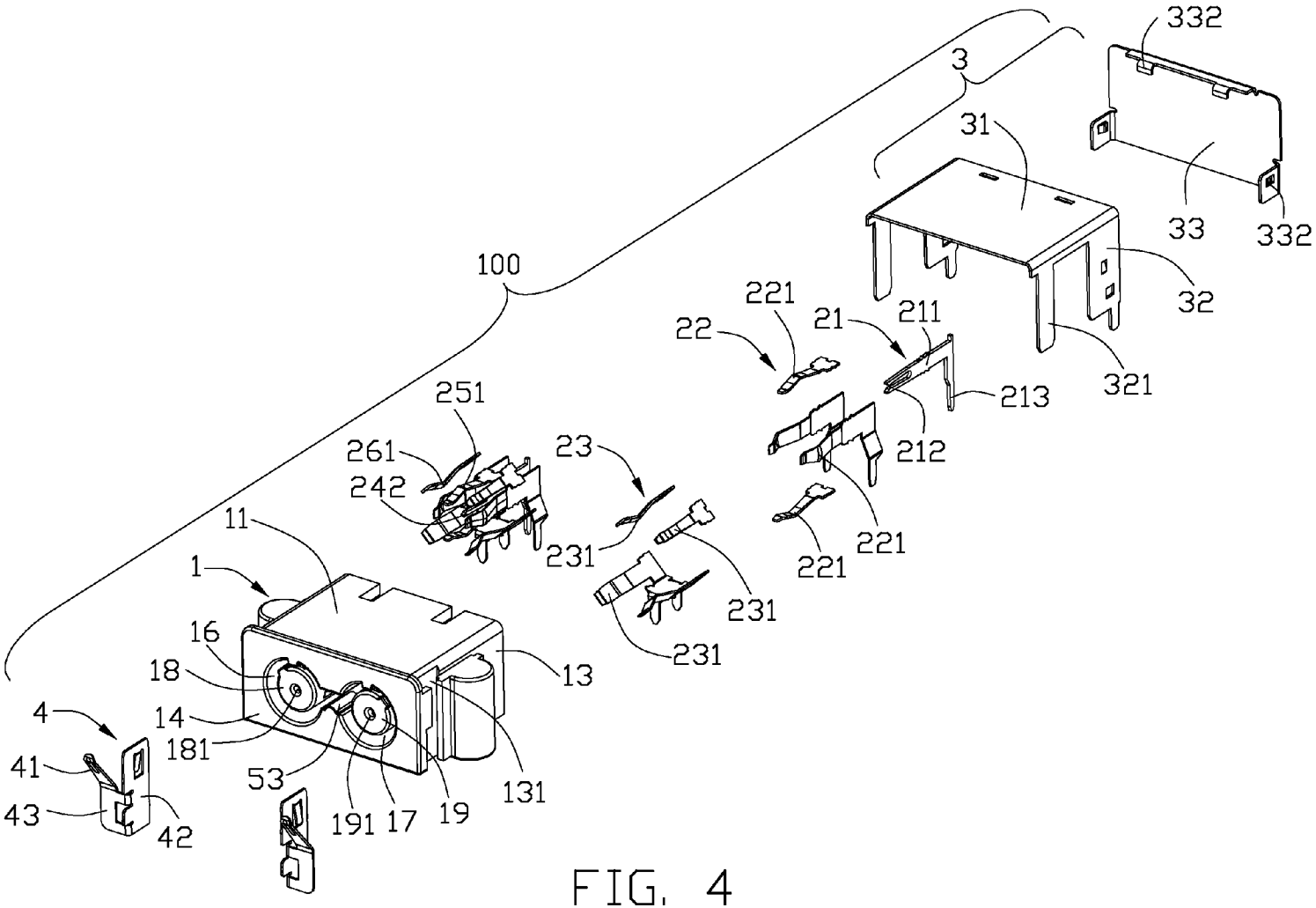
FIG. 4 is an exploded view of the power socket shown in FIG. 1.
Figure 5:
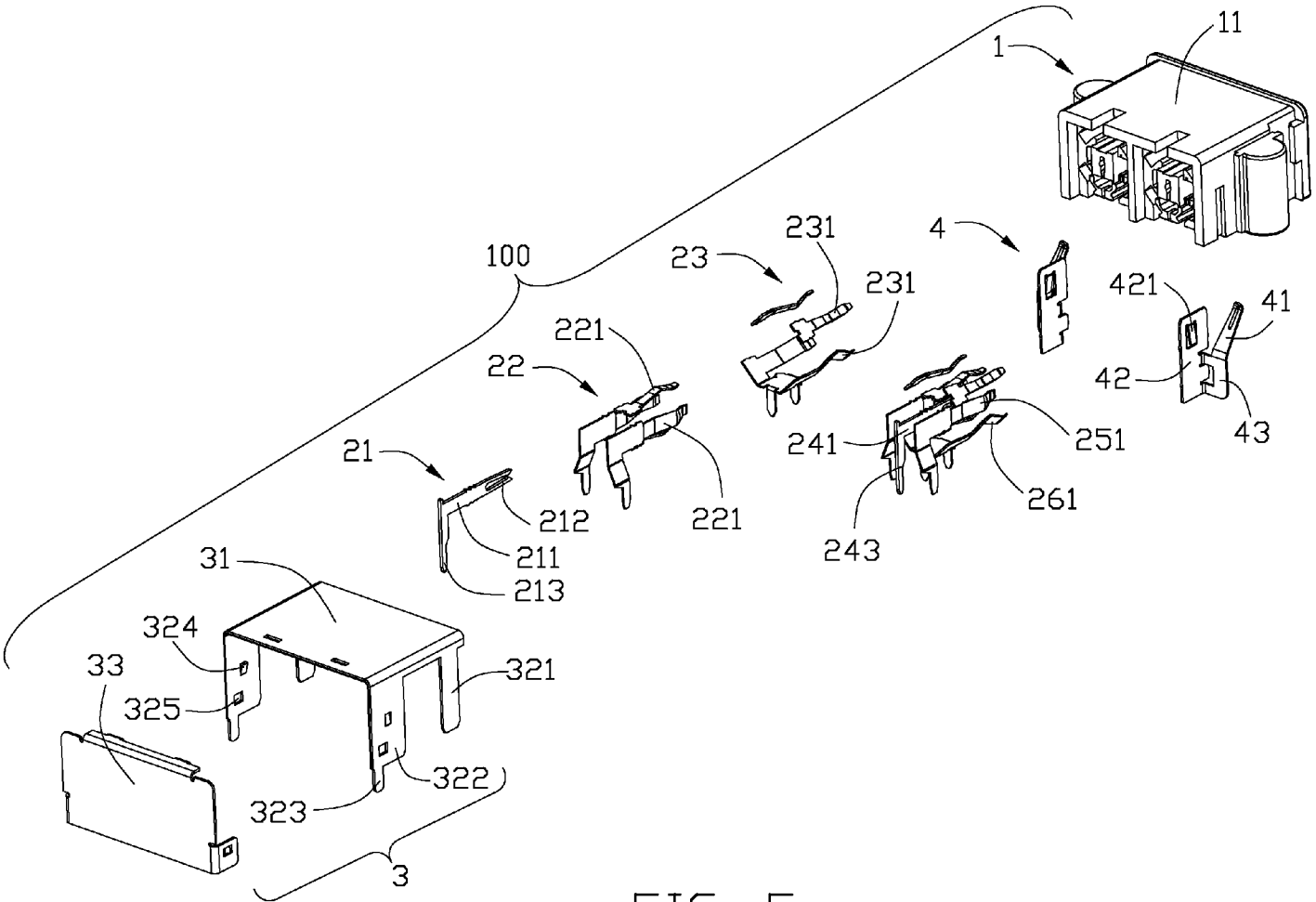
FIG. 5 is a view similar to FIG. 4, while taken from a different aspect.
Figure 6:
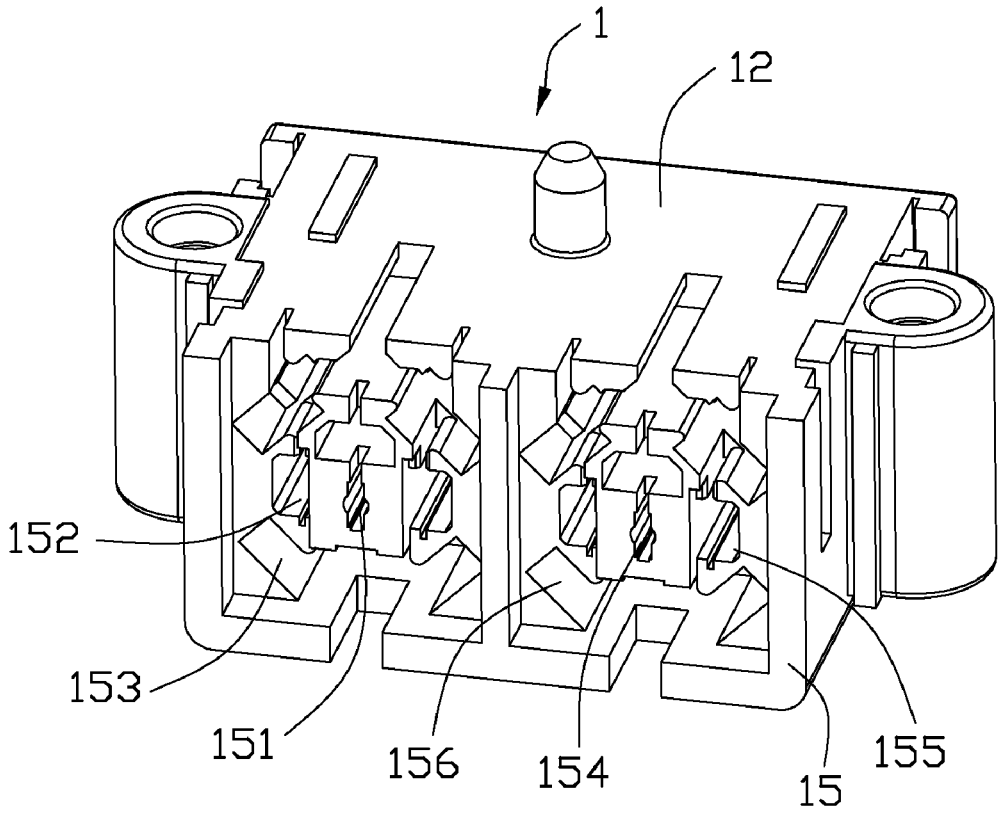
FIG. 6 is perspective view of an insulative housing of the power socket shown in FIG. 1.
Figure 7:
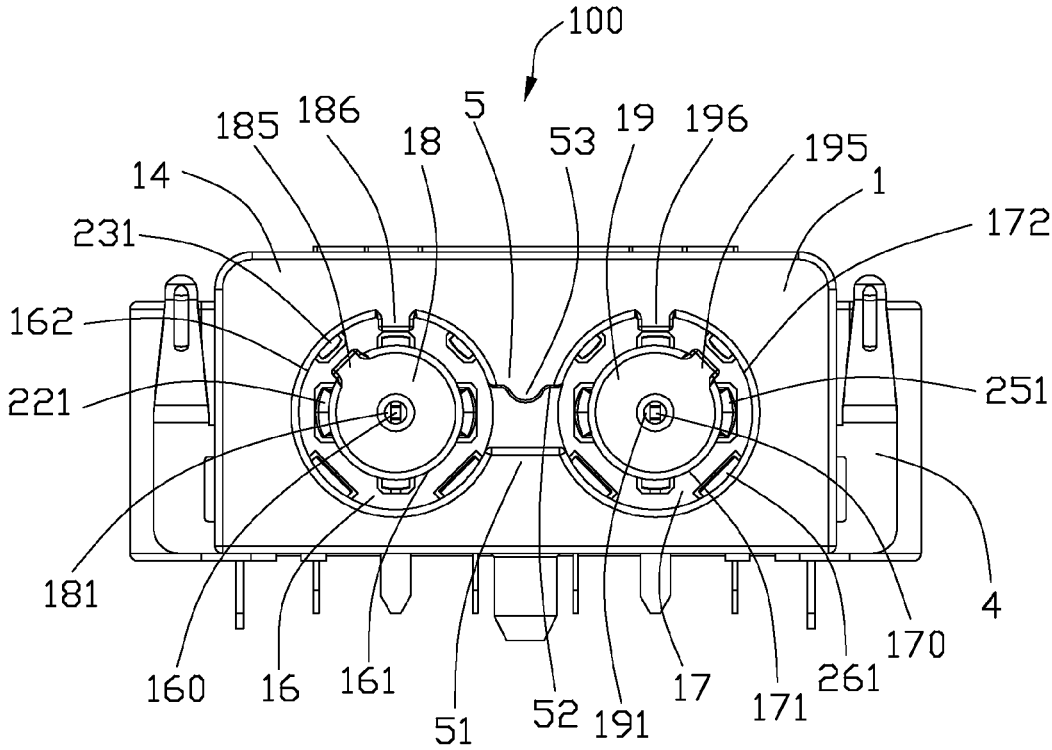
FIG. 7 is a front elevational view of a power socket in another embodiment of the present invention.

Referring to FIGS. 2, 4 and 5, each side wall 13 of the insulative housing 1 defines a slot 131 for retaining the grounding tab 4. The slot 131 is located at a front side of the side wall 13 and extends through the side wall 13 along the top to down direction. The insulative housing 1 defines a plurality of first, second and third channels 151, 152, 153 corresponding to the first, second and third passageways 181, 183, 184 respectively, and a plurality of fourth, fifth and sixth channels 154, 155, 156 corresponding to the fourth, fifth and sixth channels 191, 193, 194 respectively.

The contacts 2 comprise a first contact 21 retained in the first passageway 181, a plurality of second contacts 22 retained in the second passageways 183, and a plurality of third contacts 23 retained in the third passageways 184. The first contact 21 has a first securing portion 211 retained in the first channel 151, a forked first contact portion 212 extending forwardly into the first passageway 181 from the first securing portion 211 and a first tail portion 213 bending perpendicularly downwardly from the first securing portion 211. The second contacts 22 engage with the second channels 152 and each has a second contact portion 221 cantileveredly received in the second passageways 183. The third contacts 23 engage with the third channels 153 and each has a third contact portion 231 cantileveredly received in the third passageways 184. The second and third contact portions 221, 231 extend into the first groove 16 for sandwiching the corresponding power plug therebetween.

The contacts 2 also comprise a fourth contact 24 retained in the fourth passageway 191, a plurality of fifth contacts 25 retained in the fifth passageways 193, and a plurality of sixth contacts 26 retained in the sixth passageways 194. The fourth, fifth and sixth contacts 24, 25, 26 have same structures with the first, second and third contacts 21, 22, 23 respectively. The fourth contact 24 has a fourth securing portion 241 retained in the fourth channel 154, a forked fourth contact portion 242 extending forwardly into the fourth passageway 191 from the fourth securing portion 241 and a fourth tail portion 243 bending perpendicularly downwardly from the fourth securing portion 241. The fifth contacts 25 engage with the fifth channels 155 and each has a fifth contact portion 251 cantileveredly received in the fifth passageways 193. The sixth contacts 26 engage with the sixth channels 156 and each has a sixth contact portion 261 cantileveredly received in the sixth passageways 194. The fifth and sixth contact portions 251, 261 extend into the second groove 17 for sandwiching the power plug therebetween.

Referring to FIGS. 4-5, the metal shell 3 has a top wall 31, a pair of side walls 32 bending downwardly from two sides of the top wall 31 and a rear cover 33 engaging with the side walls 32. Each side wall 32 comprises a first side wall 321 and a second side wall 322 which are spaced from each other along the front to back direction. The first side wall 321 is received in the slot 131. The second side wall 322 has a mounting leg 323 extending downwardly and a locking tang 324 extending inwardly to engage with the insulative housing 1. The top wall 31 and side walls 32 define a plurality of openings 312, 325. The rear cover 33 has a plurality of latch strips 332 locking with the openings 312, 325.

Each grounding tab 4 has a retention portion 42 retained in the slot 131, a connecting portion 43 bending from the retention portion 42, and a spring arm 41 extending obliquely forwardly from the connecting portion 43. The retention portion 42 is perpendicular to the mating wall 14 and located at an inner side of the first side wall 321. The retention portion 42 has a resilient strip 421 extending outwardly to abut against the first side wall 321. The spring arm 41 extends out of the mating wall 14 for abutting against a shell of electronic device (not shown). The grounding tabs 4 are dividedly manufactured with the metal shell 3, therefore, the grounding tabs 4 can be made of material with good elasticity, and the metal shell 3 can be made of a common material for decreasing cost. In addition, the retention portions 42 are retained behind the mating wall 14, so the spring arm 41 can be resisted backwardly to be received in two sides of the side walls 13 and behind the mating wall 14, thereby the mating wall 14 can affixes to the shell of the electronic device for connecting with the corresponding power plug conveniently.

As fully described above, the power socket 100 in the present invention defines a projection 185, 195 extending into the grooves 16, 17 which can prevent a familiar round power plug from being inserted therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A power socket comprising:

an insulative housing defining an annular first groove and a first cylinder disposed within the first groove, an annular second groove located at one side of the first groove along a transverse direction thereof and a second cylinder disposed within the second groove, the first groove defining a first inner surface and a first outer surface, the first cylinder defining a first passageway extending through a centre portion thereof along a front to back direction;

a first contact having a first contact portion extending into the first passageway;

a plurality of second contacts, each second contact having a second contact portion extending into the first groove; and means extending into the first groove for preventing a familiar round power plug from being inserted into the first groove;

wherein the insulative housing further defines a transverse through hole communicating with the first and second grooves and an arc protrusion extending into the through hole along a top to down direction for preventing a corresponding plug from being inserted reversely.

2. The power socket as claimed in claim 1, wherein the first inner surface is an outer surface of the first cylinder, and the first inner surface and the first outer surface have a same centre heart which is the centre portion of the first cylinder.

3. The power socket as claimed in claim 1, wherein the means is a first projection projecting from the first inner surface into the first groove.

4. The power socket as claimed in claim 3, wherein the first projection extends obliquely and upwardly.

5. The power socket as claimed in claim 4, wherein the insulative housing has a second projection extending vertically downwardly into the first groove from the peak of the first outer surface.

6. The power socket as claimed in claim 1, wherein the first cylinder defines a plurality of second passageways recessed from the first inner surface for receiving the second contact portions, the second passageways communicate with the first groove.

7. The power socket as claimed in claim 1, wherein the second groove defines a second inner surface and a second outer surface opposed to each other, and the second cylinder defines a fourth passageway extending through a centre portion thereof along the front to back direction, and the contacts further comprise a fourth contact with a fourth contact portion received in the fourth passageway.

8. The power socket as claimed in claim 7, wherein the contacts further comprise a plurality of fifth contacts, and each fifth contact has a fifth contact portion extending into the second groove.

9. The power socket as claimed in claim 7, wherein the second inner surface is an outer surface of the second cylinder, and the second cylinder has a third projection extending obliquely and upwardly from the second inner surface, the third projection is symmetrical to the first projection.

10. A power socket comprising:

an insulative housing defining a mating wall, an annular first groove recessed from the mating wall and a first cylinder disposed in the first groove, the insulative housing defining a slot at one side thereof;

a plurality of contacts retained in the insulative housing;

a grounding tabs attached to the insulative housing;

wherein the grounding tab has a retention portion retained in the slot and a spring arm extending forwardly, and the retention portion is located behind the mating wall, and the spring arm forwardly extends out of the mating face for abutting against a shell of an electronic device.

11. The power socket as claimed in claim 10, wherein the first groove defines a first inner surface and a first outer surface opposed to each other, the insulative housing defines a plurality of second passageways recessed from the first inner surface and a plurality of third passageways recessed from the first outer surface, the second passageways are offset from the third passageways along both a circumferential direction and a radial direction of the first cylinder.

12. The power socket as claimed in claim 11, wherein the contacts comprises a plurality of second contacts and third contacts, each second contact has a second contact portion extending to the second passageway and extending out of the first inner surface, each third contact has a third contact portion extending to the third passageway and extending out of the first outer surface, the second contact portions and third contact portions are received in the first groove for sandwiching the corresponding power plug therebetween.

13. The power socket as claimed in claim 11, wherein the insulative housing has a first projection extending into the first groove from the first inner surface, the first inner surface is an outer surface of the first cylinder, and the first projection extends obliquely and upwardly from the first inner surface into the first groove.

14. The power socket as claimed in claim 13, wherein the insulative housing defines an annular second groove which is located with the first groove side by side, a second cylinder disposed within the second groove, and a transverse throughhole communicating with the first and second grooves, an arc protrusion extends into the throughhole along a top to down direction for preventing a corresponding plug from being inserted reversely.

15. The power socket as claimed in claim 14, wherein the insulative housing has another projection extending into the second groove, the projection in the second groove is symmetrical to the first projection in the first groove.

16. A power socket comprising:

an insulative housing defining a pair of mating ports communicating with an exterior in a front-to-back direction, and side by side communicatively arranged with each other via a transverse passage, and each of said mating ports including an annual groove defined between a round columnar inward outer surface and a round columnar outward inner surface; wherein an axially extending first key unitarily formed on outer surface toward the inner surface, and an axially extending second key unitarily on the inner surface toward the outer surface under condition that said first key and said second key are located in different radial directions.

17. The power jack as claimed in claim 16, wherein each of said first key and said second key has a corresponding contact aligned with each other along the corresponding radial direction.

18. The power jack as claimed in claim 16, wherein said transverse passage is defined between two opposite inner faces opposite to each other, and a protrusion is formed on one of said two opposite inner faces and protrudes into the transverse passage.

19. The power jack as claimed in claim 10, further comprising a metal shell covering the insulative housing, the metal shell has a first side wall received in the slot to engage with the retention portion and a mounting leg extending downwardly from a lower side thereof to connect with a circuit board.

20. The power jack as claimed in claim 13, wherein the insulative housing further has a second projection extending into the first groove from the first outer surface, and the first and second projections are located in different radial directions.

* * * * *